US006698471B1

(12) United States Patent
Carmack

(10) Patent No.: US 6,698,471 B1
(45) Date of Patent: Mar. 2, 2004

(54) FUEL DISPENSING NOZZLE HAVING A LEVER TRIGGER BIASED BY A TORSION WIRE COIL SPRING

(75) Inventor: Paul D. Carmack, Tipp City, OH (US)

(73) Assignee: Catlow, Inc., Tipp City, OH (US)

( * ) Notice: Subject to any disclaimer, the term of this patent is extended or adjusted under 35 U.S.C. 154(b) by 0 days.

(21) Appl. No.: 10/236,704

(22) Filed: Sep. 6, 2002

(51) Int. Cl.[7] ..... B65B 1/04
(52) U.S. Cl. ..... 141/206; 141/225
(58) Field of Search ..... 141/206–228, 141/59, 392; 251/227

(56) References Cited

U.S. PATENT DOCUMENTS 979,344 A * 12/1910 Shallow ..... 251/227
3,224,742 A * 12/1965 Ehlers ..... 141/209
3,653,415 A 4/1972 Boudot et al.
3,817,285 A 6/1974 Wilder et al.
4,022,235 A 5/1977 Murray et al.
5,289,856 A 3/1994 Strock et al.
5,832,970 A 11/1998 Carow

* cited by examiner

*Primary Examiner*—Steven O. Douglas
(74) *Attorney, Agent, or Firm*—Jacox, Meckstroth & Jenkins

(57) ABSTRACT

A fuel dispensing nozzle includes a nozzle body defining a fuel supply passage in which a main control valve is operated by a hand actuated lever pivotally connected to an automatic shut-off mechanism. A protective guard member encloses the lever, and a trigger member is pivotally connected to the lever for manual movement to engage a stop supported by the guard member. A torsion wire coil spring includes a plurality of helical turns surrounding the pivot pin for the trigger member and has one projecting end portion engaging the lever and an opposite end portion biasing the trigger member.

2 Claims, 1 Drawing Sheet

FUEL DISPENSING NOZZLE HAVING A LEVER TRIGGER BIASED BY A TORSION WIRE COIL SPRING

BACKGROUND OF THE INVENTION

This invention relates to a vapor assisted fuel dispensing nozzle of the general type disclosed in U.S. Pat. No. 5,832,970. In such a nozzle, a nozzle body defines a fuel supply passage, and a normally closed main control valve is actuated by a lever pivotally supported by the nozzle body for controlling the supply of fuel through the fuel supply passage. The lever is protected by a guard member secured to the body, and the actuating lever carries a latch or trigger member which is pivotally supported by a cross pin. The trigger member has an outer end portion adapted to engage a catch or stop member supported by the guard member, and a spring member biases the trigger member towards the lever. Actuation of the trigger member functions to hold the actuating lever and the fuel supply valve in their open positions until the nozzle spout detects the presence of fuel and automatically lifts the lever to release the trigger member and permit the lever and fuel supply valve to return to their normally closed positions.

As disclosed in the above '970 patent, the latch or trigger member 78 is biased against a stop on the actuating lever 60 by a conventional sheet metal leaf spring 84 which extends above the pivot pin for the latch or trigger member 78. Such a sheet metal leaf spring has been used for over 30 years and is disclosed, for example, in U.S. Pat. No. 3,653,415, U.S. Pat. No. 3,817,285, U.S. Pat. No. 4,022,235 and U.S. Pat. No. 5,289,856. After a fuel dispensing nozzle has been used for filling fuel tanks with an automatic shut-off of the valve actuating lever for approximately 100,000 times, it has been found that the leaf spring fatigues and fails by weakening and/or breaking. This requires that the nozzle be serviced by removing the trigger member and replacing the leaf spring. Frequently, the leaf spring is one of the first components to fail, which usually requires that the fuel dispensing nozzle be removed from the fuel supply hose and shipped back to the nozzle manufacturer or rebuilder to replace the leaf spring.

SUMMARY OF THE INVENTION

The present invention is directed to a fuel dispensing nozzle of the type described above and which incorporates an improvement for significantly extending the service life of the nozzle before requiring replacement or rebuilding. The improvement comprises replacing the conventional leaf spring for actuating the latch or trigger member with a formed wire coil torsion spring having a plurality of turns mounted on the pivot pin for the latch or trigger member. The wire coil spring has opposite end portions which engage the valve actuating lever and the trigger member.

Other features and advantages of the invention will be apparent from the following description, the accompanying drawing and the appended claims.

DESCRIPTION OF THE PREFERRED EMBODIMENT

Figure 1:
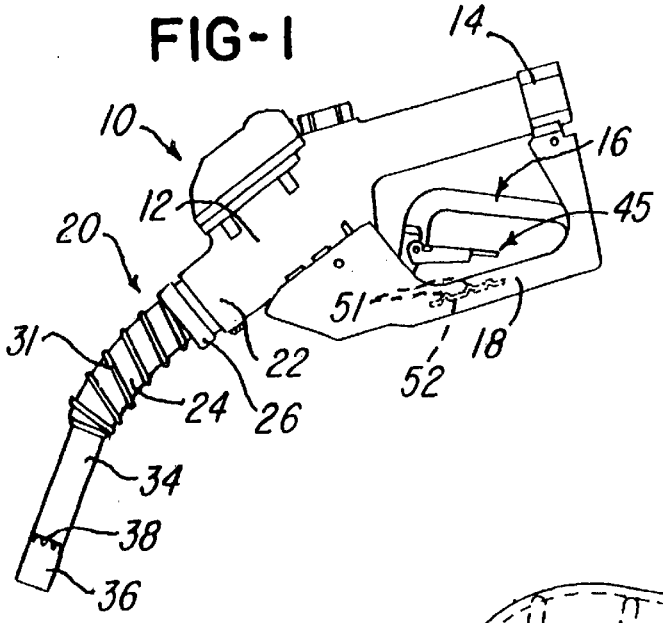
FIG. 1 is a side elevational view of a vacuum assist vapor recovery fuel dispensing nozzle constructed in accordance with the invention.

FIG. 1 illustrates a vacuum assist vapor recovery fuel dispensing nozzle 10 having the general construction of the dispensing nozzle disclosed in above-mentioned Patent No. 5,832,970, the disclosure of which is incorporated by reference. The nozzle 10 includes a die cast aluminum body 12 having an integral internally threaded fitting 14 for receiving a mating fitting on a coaxial flexible rubber hose (not shown) defining a fluid supply passage and a vapor return passage connected to a vacuum source. The nozzle 10 includes a normally closed fuel control valve (not shown) which is actuated to an open position by squeezing a hand actuated lever 16 enclosed within a lever protector housing 18.

The nozzle body 12 supports a spout assembly 20 which projects from a forward portion 22 of the nozzle body 12. The spout assembly 20 includes an outer spout tube 24 constructed of aluminum tubing and having an inner end portion threaded into an anti-rotation ring or fitting secured to the body end portion 22 by a retaining nut 26. A resilient O-ring forms a fluid-tight seal between the fitting and the body portion 22, and a helically wound spring wire 31 surrounds the spout tube 24, in a conventional manner. The aluminum outer spout tube 24 includes an integral cylindrical forward end portion 34 having a thinner wall thickness and which surrounds a stainless steel vapor recovery extension spout tube 36 having circumferentially spaced and axially extending slots or grooves 38.

Figure 2:
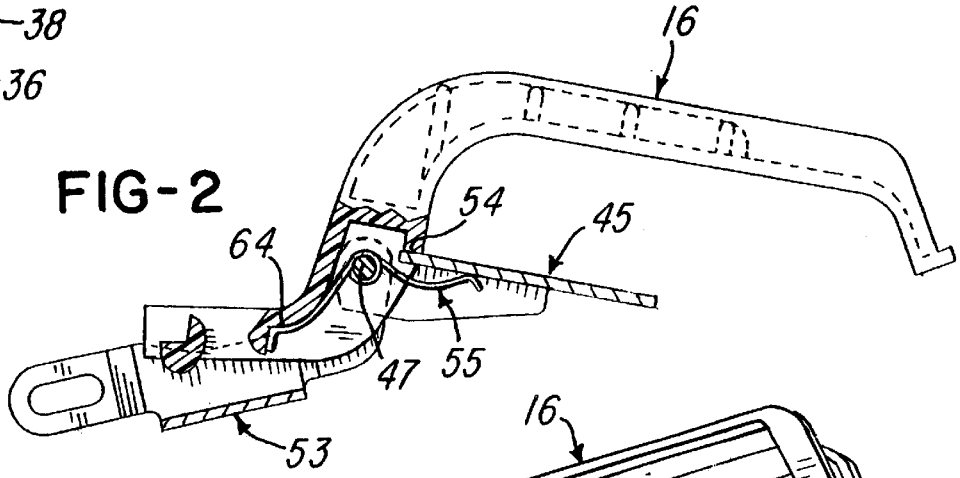
FIG. 2 is a side elevational view of the actuating lever assembly with a portion broken away to show the use of a wire coil torsion spring in accordance with the invention.
Figure 3:
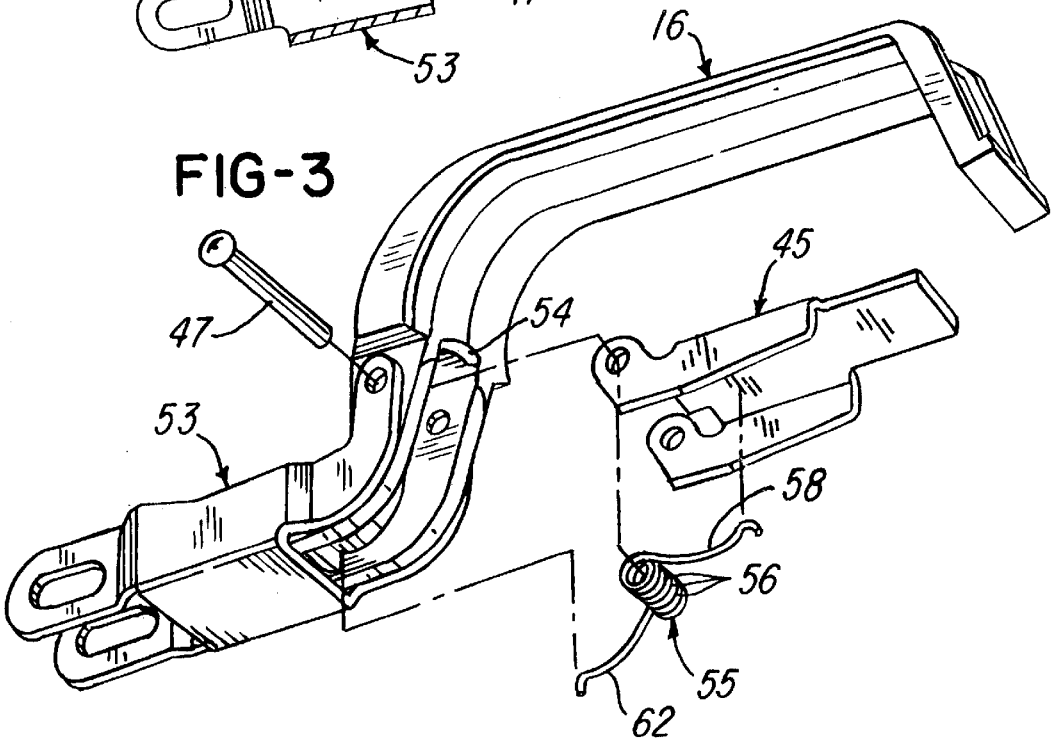
FIG. 3 is an exploded perspective view of the assembly shown in FIG. 2.

Referring to FIGS. 2 & 3, the actuating lever 16 carries a latch or trigger member 45 which is pivotally supported by the lever 16 by a cross pin 47 and moves between a normal position (FIG. 2) and a downwardly projecting inclined position (not shown) where the outer end of the trigger member 45 selectively engages one of a series of projections 51 of a stop member 52 mounted within the lever protector housing 18. The pin 47 also pivotally supports a channel-like link member 53 which connects the lever 16 to its pivot pin supported by an automatic lever release mechanism.

In accordance with the present invention, the trigger member 45 is biased or urged counter-clockwise (FIG. 2) against a stop surface 54 on the lever 16 by a torsion wire coil spring 55 having a plurality of at least five helical turns 56 (FIG. 3) surrounding the pivot pin 47 for the trigger member 45. The torsion wire coil spring 55 has one projecting end portion 58 which engages and presses agains the trigger member 45 and an opposite end portion 62 which engages a receiving surface 64 formed on the actuating lever 16.

It has been found that the torsion wire coil spring 55 significantly increases the useful service life of the pivotal trigger member 45 and thereby significantly increases the service life of the nozzle 10 with an automatic fill shut-off mechanism. More specifically, extensive testing of the trigger member 45 during its use for holding the main fuel control valve in its open position has resulted in over one million pivotal actuations of the trigger member 45 without any failure of the wire coil spring 55. This compares with approximately one hundred thousand actuations of a trigger member biased by a conventional leaf spring when the leaf spring failed. Thus by simply replacing a conventional leaf spring with the torsion wire coil spring 55, the service life of the dispensing nozzle 10 is significantly increased. As a result, the cost for servicing the nozzle 10 is significantly decreased.

While the form of nozzle assembly herein described constitutes a preferred embodiment of the invention, it is to be understood that the invention is not limited to this precise form of nozzle assembly, and that changes may be made therein without departing from the scope and spirit of the invention as defined in the appended claims.

What is claimed is:

1. A fuel dispensing nozzle comprising a nozzle body defining a fuel supply passage, a valve for controlling the supply of fuel through said fuel supply passage, a hand actuated lever pivotally supported adjacent said body and connected to operate said valve, said lever having parallel spaced side walls and a stop surface, a guard member connected to said body for protecting said lever, a trigger member having parallel spaced side walls extending with said side walls of said lever therebetween, a pivot pin extending through aligned holes within said side walls of said lever and said side walls of said trigger member and providing for substantial angular movement of said trigger member relative to said lever, said trigger member having an outer end portion adapted to engage at least one stop projection on said guard member, a torsion wire coil spring having opposite projecting end portions integrally connected by a plurality of helical wire turns, said wire turns surrounding said pivot pin and disposed between said side walls of said lever, one of said end portions of said wire coil spring pressing against said lever, and an opposite said end portion of said wire coil spring pressing against said trigger member for biasing said trigger member towards said stop surface on said lever.

2. A nozzle as defined in claim 1 wherein said spring includes at least five of said wire turns mounted on said pivot pin.

* * * * *